US006499268B2

(12) United States Patent
James

(10) Patent No.: US 6,499,268 B2
(45) Date of Patent: Dec. 31, 2002

(54) REINFORCING STRUCTURES

(76) Inventor: Peter James, 2, Redd Landes, Shirenewton, Chepstow, Gwent (GB)

( * ) Notice: Subject to any disclaimer, the term of this patent is extended or adjusted under 35 U.S.C. 154(b) by 0 days.

(21) Appl. No.: 09/842,784

(22) Filed: Apr. 27, 2001

(65) Prior Publication Data

US 2001/0034997 A1 Nov. 1, 2001

(30) Foreign Application Priority Data

Apr. 28, 2000 (GB) ..... 102475
Apr. 28, 2000 (GB) ..... 102483

(51) Int. Cl.[7] ..... E04C 5/00

(52) U.S. Cl. ..... 52/698; 52/742.1; 52/742.13; 52/742.16; 52/745.21; 52/146

(58) Field of Search ..... 52/741.3, 742.1, 52/742.13, 742.16, 745.05, 745.21, 514, 514.5, 703, 704, 698, 223.1, 223.13; 14/26, 73.5, 77.1

(56) References Cited

U.S. PATENT DOCUMENTS 2,950,576 A * 8/1960 Rubenstein
2,988,855 A * 6/1961 Asfour
3,204,416 A * 9/1965 Williams
3,336,758 A * 8/1967 Williams
3,379,016 A * 4/1968 Williams
3,638,386 A * 2/1972 Waerner
3,695,045 A * 10/1972 Williams
3,967,421 A * 7/1976 Dufossez ..... 52/146
4,221,098 A * 9/1980 Mayer
4,386,876 A * 6/1983 Dupeuble
4,607,469 A * 8/1986 Harrison
4,741,141 A * 5/1988 Harke
4,930,284 A * 6/1990 Falco
4,938,631 A * 7/1990 Maechtle
5,085,026 A * 2/1992 McGill
5,540,030 A * 7/1996 Morrow
5,666,779 A * 9/1997 Fuchs
6,151,850 A * 11/2000 Sorkin
6,189,281 B1 * 2/2001 Sobek

* cited by examiner

*Primary Examiner*—Carl D. Friedman
*Assistant Examiner*—Kevin McDermott
(74) *Attorney, Agent, or Firm*—Young & Thompson

(57) ABSTRACT

A brick or masonry structure is drilled to receive an elongate reinforcing assembly comprising a core with one or more fabric sleeves over most of its length. The sleeves are injected with grout that seeps through the fabric to bond to the drilling wall. It may bond directly to the core or to a tube through which the core extends. The core is anchored to the structure at or near the mouth of the drilling while a tube farthest from the mouth may have a connection to the core that allows the core to be pulled towards the mouth with progressively greater resistance.

24 Claims, 4 Drawing Sheets

REINFORCING STRUCTURES

Figure 1:
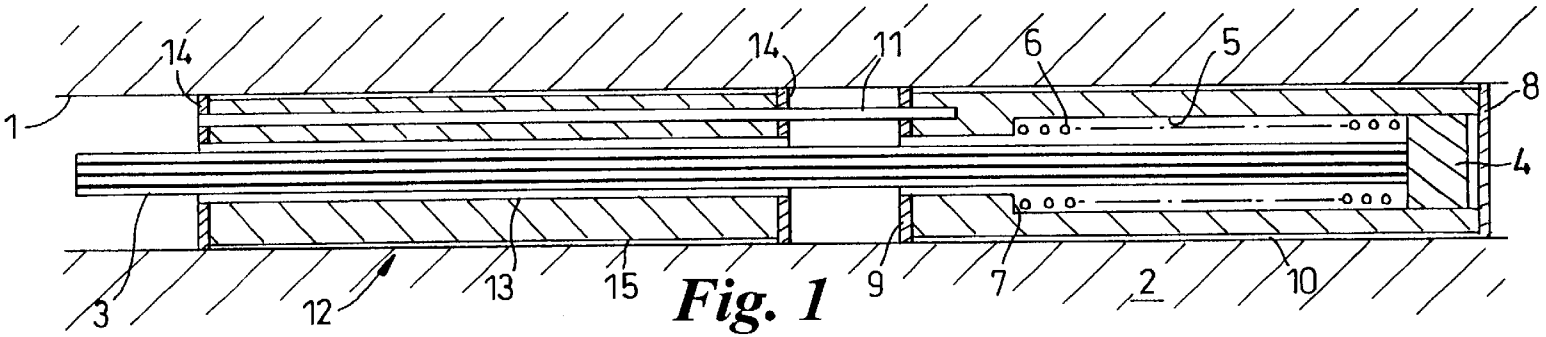

This invention relates to reinforcing structures, particularly those of brick or masonry.

It is a known technique to reinforce such a structure by drilling into it, inserting a rigid bar or rod encased in a fabric sleeve, and injecting that sleeve with cementitious grout. The grout expands to fill the space around the rod, and some seeps through the fabric to bond to the drilling wall when set. Thus, the structure acquires rigid "bones".

However, it is not always desirable to have such rigidity. Sometimes, one wants reinforcement capable of "giving" a bit without breaking, so largely maintaining its integrity and holding the structure together.

It is the aim of this invention to provide such a reinforcement with at least a limited sacrificial property.

According to the present invention there is provided a method of reinforcing a structure comprising:

drilling into the structure, inserting into the drilling an elongated reinforcement core carrying over part of its length a permeable fabric sleeve, injecting cementitious grout into the sleeve to expand that against the wall of the drilling, some grout seeping through to bond to that wall and thereby locally securing said core, and anchoring the reinforcing core at a zone distinct from the grouted sleeve to complete a reinforcing assembly.

This separation of the grouted sleeve and the anchoring zone reduces the rigidity of the reinforcement, which may distort in various ways whilst still holding the structure together even though it might be impaired.

In some versions the sleeve encases a tube which receives part of the core, there being an engagement between tube and core which progressively resists a pull on the core in the direction towards said anchoring zone.

In other words, the sleeved and grouted tube is rigid with the structure at one zone and the core is fixed to the structure at another zone (the anchoring zone). If the zones start to separate, the core meets resistance within the tube that progressively increases. Small movements within the structure are therefore easily accommodated, but should those movements increase, the reinforcement acts ever more strongly to stop them.

This progressive resistance may be provided by the tube having a gradual internal taper, narrowing in said direction, and by the core having a plug with an easy fit in the larger end of the tube, movement of the core in said direction causing the plug to wedge into the tube. Alternatively, the tube could be a cylinder, the core a piston fitting the cylinder, and the resistance a liquid against which the piston acts in said direction, there being a highly restricted route for the liquid to escape from its space within the cylinder. In another arrangement the progressive resistance may be provided by a resilient element, such as a helical spring or a thick rubber sleeve, surrounding the core and acting between a formation on the core and an abutment internal of the tube.

The anchoring can be provided within the drilling by another, similar grouted sleeve and tube assembly, within which another part of the core engages with progressive resistance to its movement in the reverse direction.

Alternatively, the anchoring may be provided within the drilling by another grout filled fabric sleeve encasing another part of the length of the core directly so that the grout bonds to the core and through the fabric to the drilling wall.

The anchoring can be external of the drilling, the core projecting clear of the structure and being held by an abutment against the surface around the mouth of the drilling. Typically, this might be achieved by screw-threading the projecting end of the core to receive an apertured plate clamped against the structure by a nut.

In all these versions the core may have at least one further permeable fabric sleeve between the first mentioned sleeve and the anchoring zone, and cementitious grout will be injected into the or each further sleeve to bond that to the drilling wall. There would thus be a "chain" of reinforcements along the drilling. Should there be any move movement within the structure, the individual sections will stay rigid, but each can move relative to the next one.

The or each further grout filled fabric sleeve can encase the core directly so that the grout bonds to the core or it can encase a tube through which the core freely passes.

To keep the sleeves apart during insertion in the drilling and thus ensure that there are exposed portions of core between each pair of adjacent sleeves, spacers may be provided, each spacer being weak in relation to the solidified grout reinforcements to either side.

With several sleeves to fill, conveniently a conduit leads from the mouth of the drilling through one or more sleeves to a remote sleeve for the injection of grout, the remote sleeve being filled first, the conduit then being partially withdrawn to terminate in the next sleeve, that sleeve being filled next via the same conduit, and so on until the sleeve adjacent the mouth is filled and the conduit is wholly withdrawn.

When the anchoring zone and the or each grouted sleeve are separated longitudinally of the drilling, the core will be locally exposed and therefore be susceptible to being bent at the or each exposed portion by distortion of the surrounding structure. But it may be beneficial to have a preferential mode of bending, in which case the core could be a plurality of parallel reinforcing rods bundled in a manner such that their collective ability to bend is easier in some directions than others.

It may also be useful for each sleeved and grouted section or group of consecutive sections to have its own core joined to another core in a gap between sections. The joint can give certain characteristics. For example, adjacent cores can be different, one being stronger than the other, and so the weak one will bend first, particularly if a fixed joint is made between adjacent cores. But there could be a flexible or linked joint, and a linked one could be loose enough also to allow limited longitudinal expansion of the reinforcing assembly.

In all these arrangements a relatively weak joint, compared with others along the assembly, can be provided so that, if there is to be failure of the structure it will tend to be around that joint.

Instead of one or more reinforcing rods the core may be at least one wire. Particularly if multi-strand and laid with a twist, it will have an inherent stretchability, and so may be firmly secured to the structure at both ends and put under moderate tension and yet allow lengthening of the reinforcements without any extra measures being taken. A wire will of course allow bending or transverse displacement of the reinforcement. But to increase the scope for extension the wire may be kinked between sections.

Figure 12:
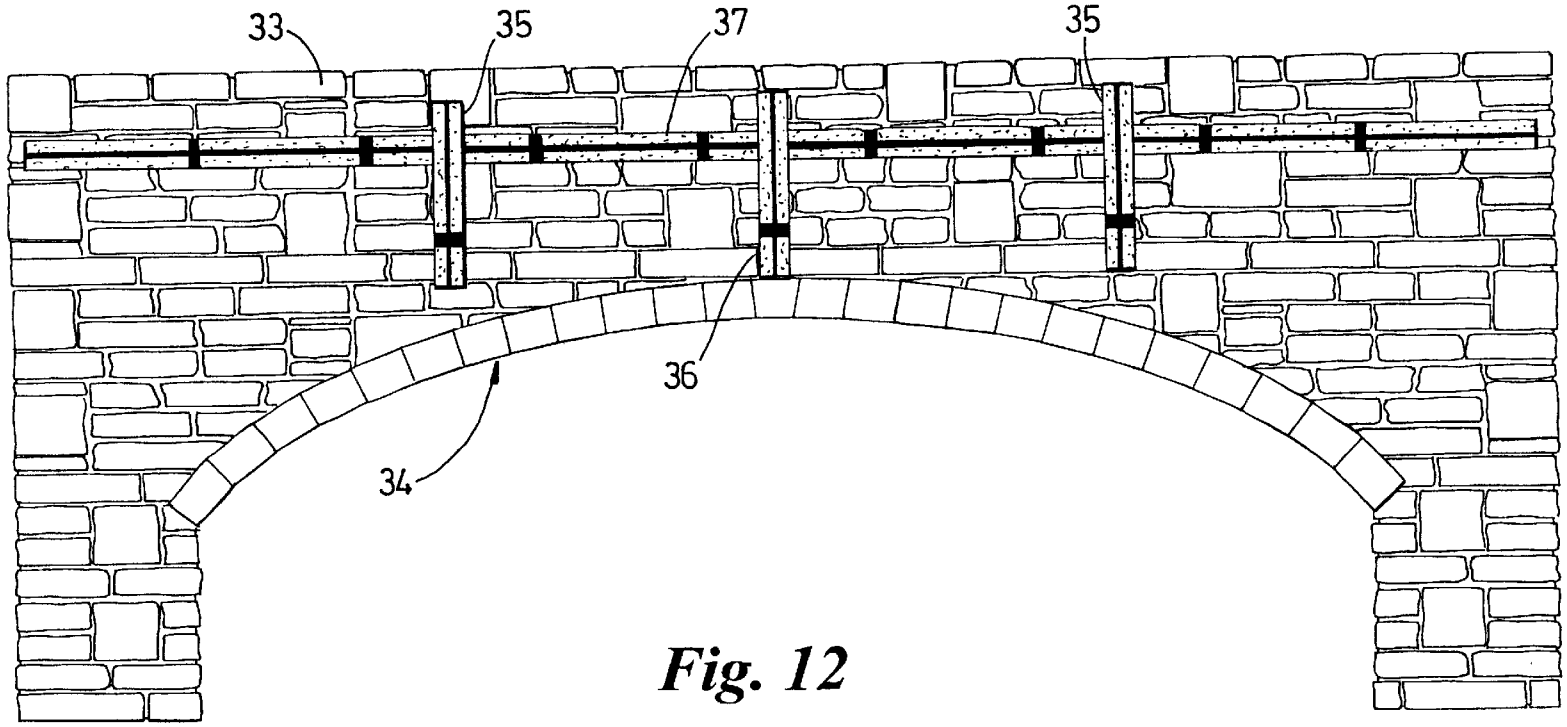
Figure 2:
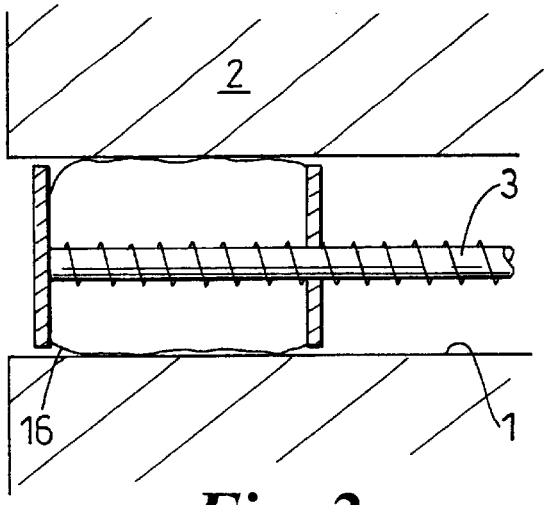
Figure 3:
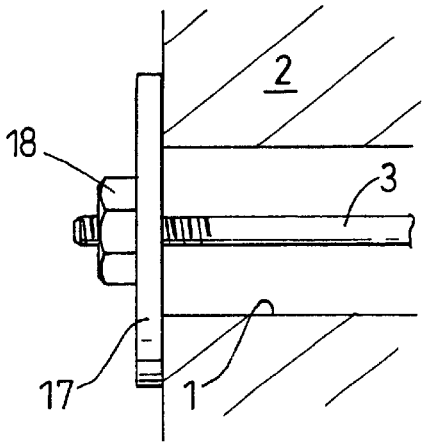

For a better understanding of the invention, one embodiment will now be described, by way of example, with reference to the accompanying drawings, in which;

FIG. 1 is an axial section of one end of a reinforcement for a brick or masonry structure, FIG. 2 is an axial section of another end of a reinforcement for a brick or masonry structure, FIG. 3 is an axial section of an alternative to FIG. 2, FIGS. 4, 5 and 6 are axial sections of alternatives to FIG. 1, FIGS. 7, 8, 9, 10 and 11 are axial sections of various intermediate parts of reinforcements for brick or masonry structures, showing joints between sections, and FIG. 12 is an elevation of a bridge, cutaway to show a parapet reinforcement.

A long drilling 1 is made into a brick or masonry structure 2. There is then fed into the drilling a reinforcing assembly of which the main unifying element is a core 3, which may be a rod or wire, with a cylindrical enlargement or plug 4 at its leading end. This is within the larger portion of a stepped tube 5 through whose smaller end the core 3 leads. A helical spring 6 surrounds the core 3 and acts between the plug 4 and the shoulder 7 provided by the internal step in the tube 5.

The larger end of the tube 5 is blanked off by a disc-like plate 8 which extends radially beyond it, and the smaller end carries a co-axial washer-like plate 8 extending radially to the same extent as the plate 9.

Between the plates 8 and 9 there is a fabric sleeve 10, and the plate 9 has an aperture through which leads an injection tube 11 from the mouth of the drilling.

When this assembly is in place, cementitious grout is injected through the tube 11, and fills the space around the tube 5, expanding the sleeve 10 against the drilling wall. Some will seep through the fabric and bond to that wall when set. Thus, there is a rigid tubular assembly effectively rigid with the structure into which the drilling was made. But the core 3 can move longitudinally relative to it, although as it is pulled to the left as seen in the figure, the spring 6 will offer increasing resistance until, when full compressed all further movement will be prevented.

The core 3 can be surrounded freely by other tubular assemblies 12 fixed within the drilling in the manner just described. They have straight tubes 13 with washer like plates 14 at each end between which there is a grout filled sleeve 15. They will be progressively filled with grout using the tube 11 which, when it has served the sleeve 10, will be pulled back an appropriate distance and then used to fill the sleeve 15, and so on. Although a bit of grout may escape through the necessary aperture in the right hand plate 14, this will generally not cause problems.

While this is the preferred method, it may be necessary in some circumstances to provide each sleeve 15 with its own injection tube, or to have groups of sleeves, each group being served by its own injection tube, progressively withdrawn as described. But then either the injection tubes have to pass through sleeves which they do not serve or they have to use the spaces between the core 3 and the tubes 13. In any event, there is rather more complexity. Of course, if the drilling 1 is not blind, there can be grout injection from both ends.

The gaps between adjacent tubular reinforcements may be maintained by skeletal spacers of plastics material, for example, or by expanded polystyrene rings of no significant mechanical strength. These could provide closed passages through which the tube 11 could pass so that, when the tube 11 is partially withdrawn to fill the next sleeve, any grout escaping from the vacated hole in the plate 14 will be confined to such a passage and, even if it does force its way back to the reinforcement that has just been filled, it will only form a thin "pencil" which can quite easily be snapped if there is relative movement.

The reinforcing assembly will have to be anchored at the other end, at or near the mouth of the drilling. There are various ways of doing this, one being to have the tubular arrangement with the progressively jamming plug described, but of course reversed. Alternatively, as shown in FIG. 2, there could be no tube but only a fabric sleeve 16 around the core 3, and the grout would then bond directly to the core, making that rigid with the structure 2 over that zone. Another arrangement, particularly if the core 3 is a rod, is shown in FIG. 3 where the core 3 projects from the mouth of the drilling 1, and the projecting part is screw threaded to receive an apertured plate 17 and a nut 18 which can clamp the plate against the structure around the mouth of the drilling.

There are also alternatives for the spring 6 providing the progressive resistance.

Figure 4:
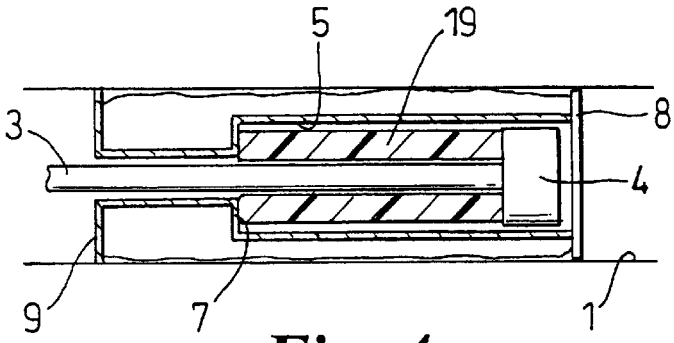

FIG. 4 shows the plug 4 acting against a thick sleeve 19 of rubber or resilient plastics material, substituting for the spring 6.

Figure 5:
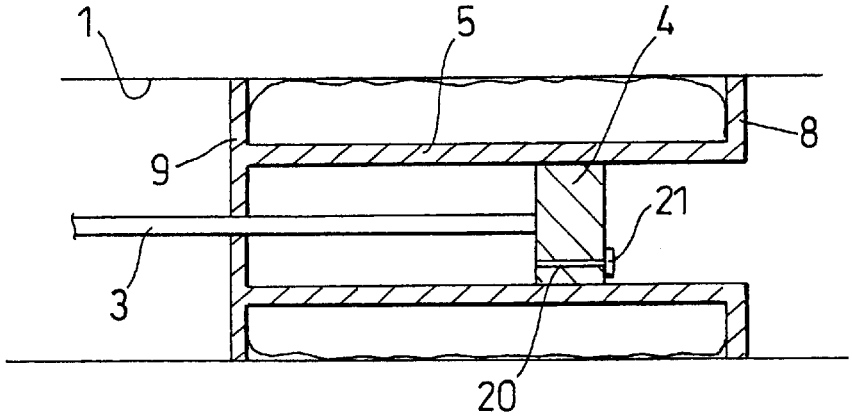

In FIG. 5 the plug 4 is a piston, the end of the core 3 is a piston rod, and the tube 5 with the plates 8 and 9 form a cylinder confining a hydraulic liquid. A very fine capillary passage 20 through the piston 4 allows the liquid to transfer from one side to the other, and a threshold may be imposed before this is possible, for example by a cap 21 over the end of the passage 20 which can only unseat when subjected to a given force.

Figure 6:
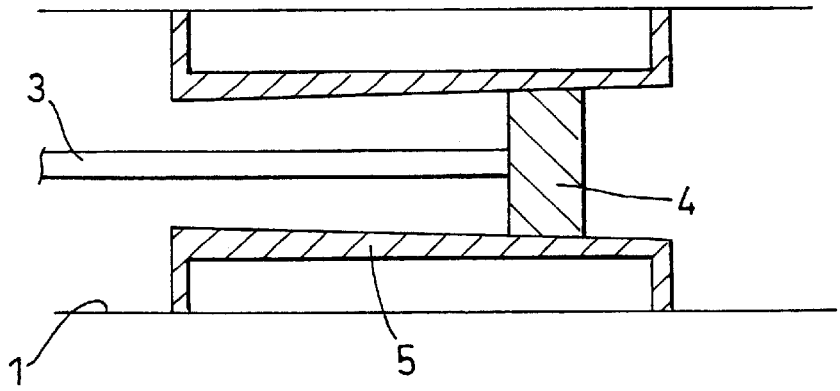

FIG. 6 illustrates yet another arrangement where the interior of the tube 5 is slightly coned, narrowing in the direction towards the mouth of the drilling. The plug 4 is an easy fit in the larger end of the tube but jams progressively harder into the tube when pulled towards the narrower end of the tube 5.

In the above examples the reinforcement can extend longitudinally and bend. However, there can be circumstances where extension is undesirable while bending should be tolerated and vice versa. For a substantially non-bending reinforcement the intermediate assemblies 12 could be butted together or, better, merged into one with the end assembly containing the tube 5. They would extend right up to the anchorage zone at the other end.

Figure 7:
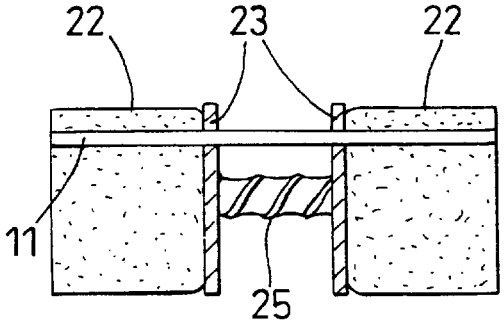
Figure 8:
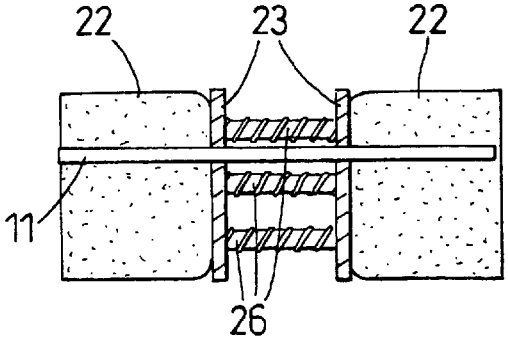
Figure 9:
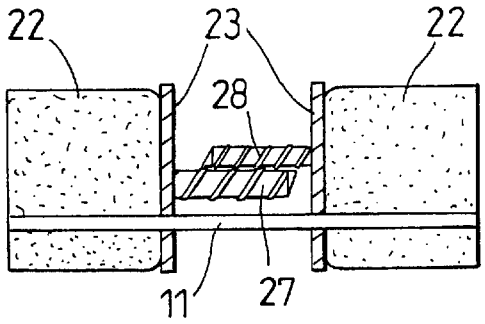

For a bending but substantially non-extending reinforcement, the arrangements of FIGS. 7, 8 and 9 can be adopted. In these Figures there are no tubes surrounding the core; there is just a fabric sleeve 22 confined between two radial plates 23 and the grout bonds to the core between those plates as well as seeping through the fabric to bond to the drilling wall. The grout injection is through a tube 24 from one end, similar to the tube 11, and the use of spacers can be as described above.

In FIG. 7, the core is just a single reinforcing rod 25. The tensile strength of the reinforcement is not much weaker between the sleeved and grouted sections than within them, but the absence of a grout jacket does mean that, if there is a strong lateral force, it will bend at the gaps between such sections.

In FIG. 8, the core comprises three parallel reinforcing rods 26, with their axes co-planar with the drawing. This will be highly resistant to bending in that plane but less so at right angles thereto, i.e. in or out of the plane of the drawing.

In FIG. 9, the core is of composite construction, adjacent sections having different gauge rods 27, 28 welded together in the gaps. Any distortion will tend to be where the smaller rod 28 emerges from its grouted section. There may be only one or two of these along the assembly, providing relative weaknesses at selected points where, if the reinforcement is to break at all, it is comparatively safe to do so.

Figure 10:
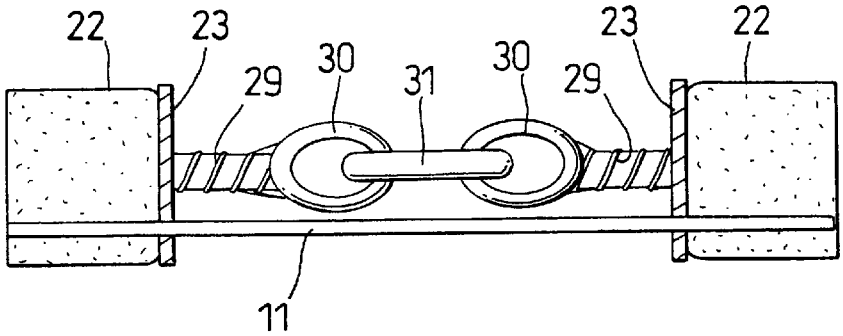
Figure 11:
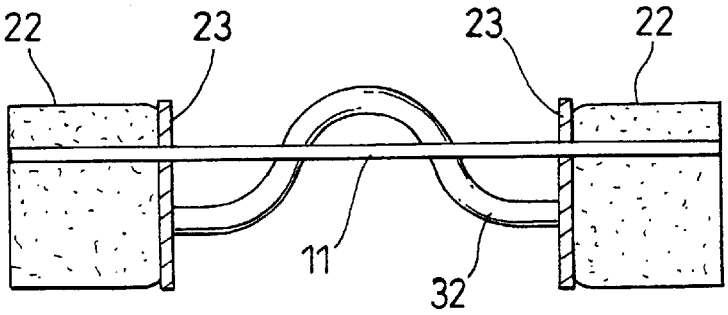

FIGS. 10 and 11 show other arrangements where there can be both extension and bending of the reinforcement.

In FIG. 10, each section is reinforced by its own rod 29, which is formed with eyes 30 at its exposed ends.

Adjacent sections are coupled by a common link 31 through these eyes 30. The sections may be set so that the link 31 is loose, thereby allowing a certain longitudinal expansion. But whether the link is tight or loose, it will allow misalignment between adjacent sections if the surrounding structure is distorted transversely to the drilling.

In FIG. 11, instead of one or more reinforcing rods, there is a wire cable 32. This may be set straight so that while it may be capable of limited extension, particularly if multi-stranded and laid with a twist, there is relatively easy lateral movement. But it could also be slightly kinked between sections, as shown here, so that it will also permit more significant longitudinal movement. As with rods, there may be more than one wire through each section.

A particular example of how these types of reinforcement might be applied in practice is shown in FIG. 12.

The parapet 33 of a bridge 34 is drilled vertically at intervals and these drillings 35 are fitting with two-section reinforcements 36 such as described above. A shorter sleeved and grouted section is lowermost, set into the main structure of the bridge below the parapet, and a larger section is within the parapet itself.

The parapet 33 is also drilled longitudinally, inside the first set of drillings, and a multi-section reinforcement 37 as described is inserted and anchored.

Should a vehicle go out of control and crash into the parapet, that may be pushed outwardly, but much of the energy will be absorbed by the anchorages extending and/or bending. The parapet may sag outwardly, but it should remain largely intact, and large portions of masonry should not fall on to any road, rail track or waterway below.

In extremis, the bond between the end grouted sleeve assembly and the drilling might fail. However, should this happen with the version of FIG. 1 where the core 3 extends freely through several assemblies 12, that end assembly will be propelled only a short distance along the drilling before it comes up against the next sleeve assembly 12, being cushioned by the spacer referred to above. Therefore complete and catastrophic failure will not occur. Even if that next sleeve assembly 12 is broken free of its bond with the drilling, there is another one beyond to arrest the movement, and so on.

What is claimed is:

1. A method of reinforcing a structure comprising:

drilling into the structure, inserting into the drilling an elongated reinforcement core carrying over part of its length a permeable fabric sleeve, injecting cementitious grout into the sleeve to expand said sleeve against the wall of the drilling, some grout seeping through to bond to said wall and thereby locally securing said core, and providing and anchoring by anchoring the reinforcing core at a zone distinct and separate from the grouted sleeve to complete a reinforcing assembly.

2. A method as claimed in claim 1, wherein the sleeve encases a tube which receives part of the core, there being an engagement between tube and core which progressively resists a pull on the core in a direction towards said anchoring zone.

3. A method as claimed in claim 2, wherein the progressive resistance is provided by the tube having a gradual internal taper, narrowing in said direction, and wherein the core has a plug with an easy fit in the larger end of the tube, movement of the core in said direction causing the plug to wedge into the tube.

4. A method as claimed in claim 2, wherein the tube is a cylinder, the core has a piston fitting the cylinder, and the resistance is liquid against which the piston acts in said direction, there being a highly restricted route for the liquid to escape from its space within the cylinder.

5. A method as claimed in claim 2, wherein the progressive resistance is provided by a resilient element surrounding the core and acting between a formation on the core and an abutment internal of the tube.

6. A method as claimed in claim 2, wherein the anchoring is provided within the drilling by another, similar grouted sleeve and tube assembly, within which another part of the core engages with progressive resistance to its movement in a direction opposite the first-mentioned direction.

7. A method as claimed in claim 1, wherein the anchoring is provided within the drilling by another grout filled fabric sleeve encasing another part of the length of the core directly so that the grout bonds to the core and through the fabric to the drilling wall.

8. A method as claimed in claim 1, wherein the anchoring is external of the drilling, said elongated reinforcing core projecting clear of the structure and being held by an abutment against the surface around the mouth of the drilling.

9. A method as claimed in claim 1, wherein the core has at least one further permeable fabric sleeve between the first mentioned sleeve and the anchoring zone, and cementitious grout is injected into said at least one further sleeve to bond said at least one further sleeve to the drilling wall.

10. A method as claimed in claim 9, wherein the or each further grout filled fabric sleeve encases the core directly so that the grout bonds to the core.

11. A method as claimed in claim 10, wherein the or each further sleeve encases a tube through which the core freely passes.

12. A method as claimed in claim 10, wherein a spacer is provided between each pair of adjacent sleeves, the or each spacer being weak in relation to the solidified grout reinforcements to either side.

13. A method as claimed in claim 9, wherein a conduit leads from the mouth of the drilling through one or more sleeves to a remote sleeve for the injection of grout, the remote sleeve being filled first, the conduit then being partially withdrawn to terminate in the next sleeve, that sleeve being filled next via the same conduit, and so on until the sleeve adjacent the mouth is filled and the conduit is wholly withdrawn.

14. A method as claimed in claim 1, wherein the anchoring zone and the or each grouted sleeve are separated longitudinally of the drilling so that the core is locally exposed, and is susceptible to being bent at the or each exposed portion by distortion of the surrounding structure.

15. A method as claimed in claim 14, wherein the core is a plurality of parallel reinforcing rods bundled in a manner such that their collective ability to bend is easier in some directions than others.

16. A method as claimed in claim 14, wherein each sleeved and grouted sleeve or group consecutive sleeves has its own core joined to another core in a gap between sleeves.

17. A method as claimed in claim 16, wherein adjacent cores are different, one being stronger than the other.

18. A method as claimed in claim 16, wherein a fixed joint is made between adjacent cores.

19. A method as claimed in claim 16, wherein a flexible joint is made between adjacent cores.

20. A method as claimed in claim 19, wherein a linked joint is made between adjacent cores.

21. A method as claimed in claim 20, wherein the linked joint is loose enough to allow limited longitudinal expansion of the reinforcing assembly.

22. A method as claimed in claim 16, wherein a relatively weak joint, compared with others along the assembly, is provided.

23. A method as claimed in claim 14, wherein the core is at least one wire.

24. A method as claimed in claim 22, wherein the wire is kinked between sections to allow limited longitudinal expansion of the reinforcing assembly.

* * * * *